US006559827B1

(12) United States Patent
Mangerson

(10) Patent No.: US 6,559,827 B1
(45) Date of Patent: May 6, 2003

(54) DISPLAY ASSEMBLY

(75) Inventor: Mark M. Mangerson, LeMars, IA (US)

(73) Assignee: Gateway, Inc., Poway, CA (US)

( * ) Notice: Subject to any disclaimer, the term of this patent is extended or adjusted under 35 U.S.C. 154(b) by 230 days.

(21) Appl. No.: 09/639,924

(22) Filed: Aug. 16, 2000

(51) Int. Cl.[7] ..... G09G 3/36
(52) U.S. Cl. ..... 345/102; 349/61; 362/561
(58) Field of Search ..... 345/102, 88; 362/31, 362/551, 583, 558, 559, 561; 349/62–67, 61

(56) References Cited

U.S. PATENT DOCUMENTS

| | | | | |
|---|---|---|---|---|
| 3,840,695 A | * 10/1974 | Fischer | ..... | 257/350 |
| 3,973,254 A | 8/1976 | Nomiya et al. | ..... | 340/336 |
| 4,978,952 A | * 12/1990 | Irwin | ..... | 345/102 |
| 5,121,233 A | * 6/1992 | Spencer et al. | ..... | 345/102 |
| 5,461,397 A | * 10/1995 | Zhang et al. | ..... | 345/102 |
| 5,774,178 A | 6/1998 | Chern et al. | ..... | 348/206 |
| 5,929,955 A | 7/1999 | Hsieh et al. | ..... | 349/106 |
| 6,002,207 A | 12/1999 | Beeteson et al. | ..... | 313/542 |
| 6,008,929 A | 12/1999 | Akimoto et al. | ..... | 359/264 |
| 6,028,588 A | 2/2000 | Yoon | ..... | 345/153 |
| 6,130,730 A | * 10/2000 | Jannson et al. | ..... | 349/64 |

FOREIGN PATENT DOCUMENTS

| | | | |
|---|---|---|---|
| JP | 11-109350 | * 4/1999 | ..... G02F/1/1335 |
| JP | 11-305194 | * 11/1999 | ..... G02F/1/133 |

OTHER PUBLICATIONS

Plasmavision W–World Wide–; http://www.fujitsugeneral.co.jp/english/products/pdpeng/4220press.htm; Mar. 15, 2000 9:03 AM.

Plasma Display—ALIS method; http://www.fujitsugeneral-.co.jp/english/products/pdpeng/alis.htm; Mar. 15, 2000 8:59 AM.

Specifications of PDS4221/PDS4222; http://www.fujitsugeneral.co.jp/english/products/pdpeng/4220_spec.htm; Mar. 15, 2000 9:06 AM.

Candescent ThinCRT Technology Primer; http://www.candescent.com/Candescent/techprim.htm; Mar. 13, 2000 11:22 AM.

ThinCRT Technology; http://www.candescent.com/Candescent/tcrtech.htm; Mar. 13, 2000 11:18 AM.

The ThinCRT Concept; http://www.candescent.com/Candescent/tcrtnpt/htm; Mar. 13, 2000 11:14 AM.

* cited by examiner

*Primary Examiner*—Richard Hjerpe
*Assistant Examiner*—Alexander Eisen
(74) *Attorney, Agent, or Firm*—Scott Charles Richardson; Kevin E. West; Suiter & Associates

(57) ABSTRACT

A display assembly is provided with individually actuateable shutter row elements. Selected ones of the shutter row elements are actuated in a predetermined sequence, blocking and allowing pulsed of light transmitted via a light guide assembly. The shutter row elements sequentially illuminate selected groups of display elements so that the display elements provide a true color instead of separate red, green and blue components of that color. In this manner, the display assembly of the present invention is capable of providing a higher fidelity image than is possible using existing display technologies.

33 Claims, 7 Drawing Sheets

DISPLAY ASSEMBLY

FIELD OF THE INVENTION

The present invention generally relates to display assemblies, and more particularly to a display assembly wherein color elements for a given display element or pixel of the display assembly are premixed and transmitted along a light guide assembly to that pixel providing a desired color instead of utilizing separate red, green and blue elements.

BACKGROUND OF THE INVENTION

Liquid crystal displays (LCDs) are used in a variety of electronic devices including portable computers, flat panel monitors, television, and the like. Present LCDs typically employ either passive matrix or active matrix technologies. Passive matrix LCDs employ an array of liquid crystal cells that are controlled by transistors outside of the display area wherein one transistor controls an entire row or column of pixels within the display. Passive matrix LCDs provide good contrast for monochrome displays. However, their resolution is weaker for color screens. Passive matrix LCDs are also difficult to view from angles other than straight on angles. Active matrix LCDs, on the other hand, utilize an individual circuit to control the output of each pixel of the display. Active matrix LCDs typically employ an array of thin film transistors (TFT) integrated within the display area, at least one per liquid crystal cell, for individually controlling each cell. Consequently, active matrix LCDs provide better resolution than passive matrix LCDs, and are viewable from all angles. However, because of their increased complexity, active matrix LCDs are more complex to manufacture and, as a result, substantially more costly.

Wherein color is desired, each pixel of both passive and active matrix LCDs utilize separate red, green and blue sub-elements comprised of a red, green, and blue filter and at least three liquid crystal cells for varying the intensity of light transmitted through each element relying on the human eye to mix the red, green and blue light components provided so that the viewer perceives the desired color. However, because the viewer's eye must mix the separate light components the fidelity of such displays is limited. Further, color LCDs, especially color active matrix LCDs, are extremely complex. For example, a typical color active matrix LCD having a 1600×1200 display (1600 columns by 1200 rows of pixels) would have over 5.76 million elements. Similarly, because each pixel contains integral circuitry (for example, three TFTS), the density of pixels in such displays is limited.

Accordingly, it would be advantageous to provide a display assembly yielding a higher fidelity image than is possible using existing LCDs by premixing the color components of colors to be displayed by each pixel of the display assembly instead of employing separate red, green and blue elements. It would be further advantageous to provide a display assembly capable of having an equal or greater pixel density than existing LCDs while employing a reduced number of elements, thereby making the display assembly more robust, easier to manufacture, and less costly.

SUMMARY OF THE INVENTION

The present invention is directed to a display assembly wherein color components for each display element or pixel of the display assembly are premixed so that the display elements provide a true color instead of separate red, green and blue components of that color. In this manner, the display assembly of the present invention is capable of providing a higher fidelity image than is possible using existing display technologies such as LCDs or the like.

In accordance with a first aspect of the invention, the display assembly includes an optical shutter assembly including a plurality of individually actuateable shutter elements capable of substantially allowing or blocking transmission of pulses of light conducted to the optical shutter assembly by a light guide assembly. Selected shutter elements are actuated in a predetermined sequence for allowing transmission of each pulse of light through the shutter assembly so as to sequentially illuminate selected groups of display elements wherein the viewer's persistence of vision allows the viewer to form an image on the display. In an exemplary embodiment, the display assembly includes a light source suitable for emitting pulses of light and a display surface having a plurality of display elements formed by the intersection of light conducting columns of the light guide assembly and shutter row elements of the optical shutter assembly. Each light conducting column conducts pulses of light received from the light source along an axis of the display surface. A color adjustment assembly adjusts the color of pulses of light conducted by that light conducting column so that each display element of the display assembly provides a true color.

In accordance with a one aspect of the invention, an exemplary display assembly may utilize shutter elements to selectively reflect coherent light to a display surface such as a diffuser or the like. In an exemplary embodiment, the display assembly includes a light source capable of emitting a pulse of generally coherent light. A plurality of light conducting columns conduct pulses of generally coherent light received from said light source along an axis of the display assembly. Each light conducting column includes a color adjustment assembly for adjusting the color of pulses of generally coherent light conducted by the light conducting column. A plurality of shutter rows selectively reflects the pulses of generally coherent light conducted from said light source via said plurality of light conducting columns. Selected ones of the shutter rows are actuated in synchronization with the pulses of generally coherent light emitted from said light source allowing reflection of said generally coherent pulses of light for illuminating a display surface such as a diffuser, screen, wall or the like.

It is to be understood that both the forgoing general description and the following detailed description are exemplary and explanatory only and are not restrictive of the invention as claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous advantages of the present invention may be better understood by those skilled in the art by reference to the accompanying figures in which.

DETAILED DESCRIPTION OF THE INVENTION

Figure 1:
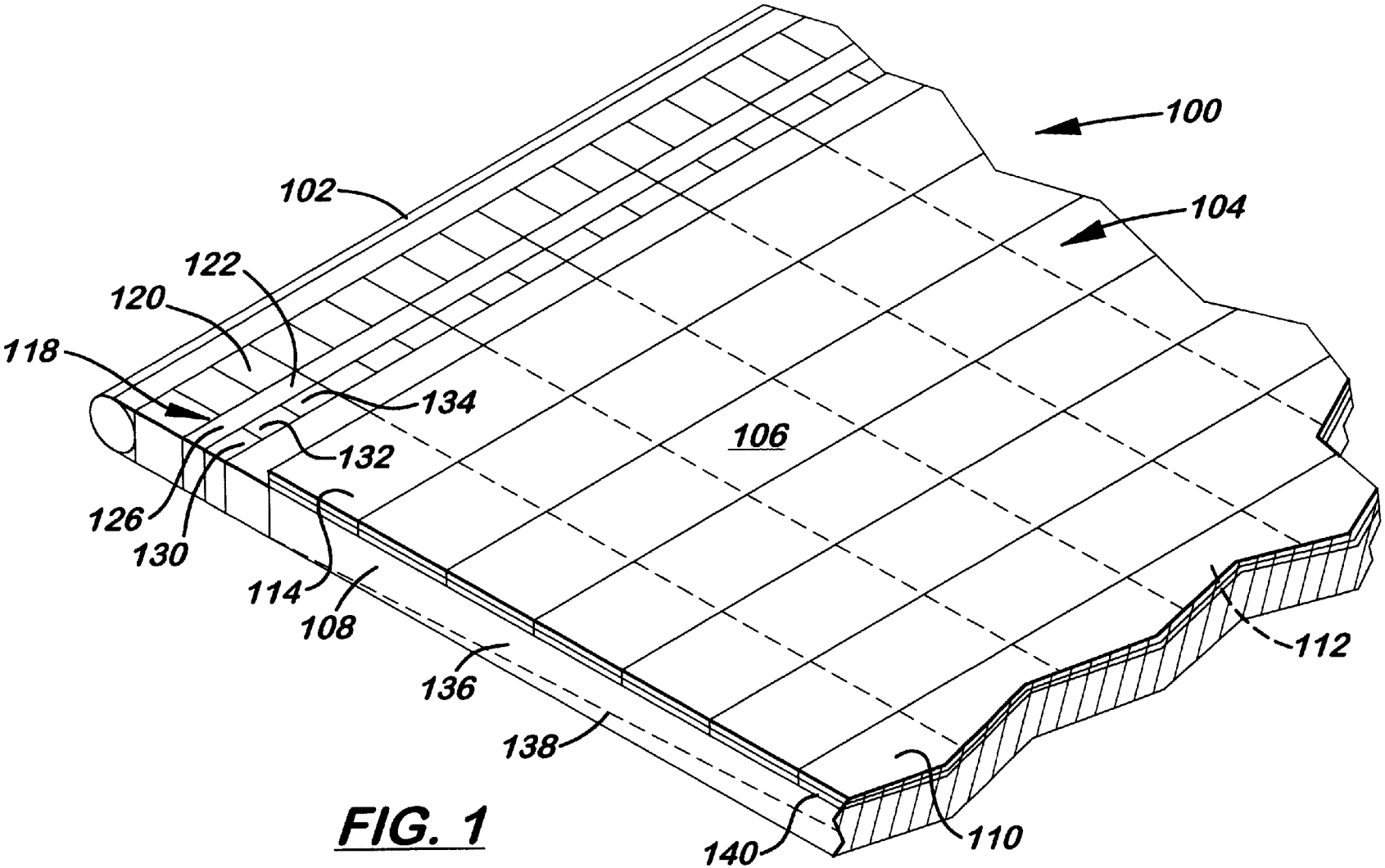
FIG. 1 is an isometric diagrammatic view of a display assembly in accordance with an exemplary embodiment of the present invention.

Reference will now be made in detail to the presently preferred embodiments of the invention, examples of which is illustrated in the accompanying drawings.

Referring generally to FIGS. 1 through 4, the general structure of a display assembly in accordance with an exemplary embodiment of the present invention is described. The display assembly 100 includes a light source 102 coupled to a display surface 104 having a display area 106 suitable for displaying an image or images to a viewer. The display surface 104 is comprised of a light guide assembly 108 forming a first or lower layer of the display surface 104 and an optical shutter assembly 110 forming a second or upper layer of the display surface 104 within at least the display area 106. The light guide assembly 108 is comprised of a plurality of substantially parallel light conducting columns 112 extending along one axis of the display surface 104. In a like manner, the optical shutter assembly 110 is comprised of a plurality of substantially parallel rows of elongated shutter elements 114 generally disposed over the light conducting columns 112 of light guide assembly 108. Preferably, the shutter elements 114 are arranged along a second axis of the display assembly 100 so as to cross light conducting columns 112 to form a plurality of display elements or pixels 116 within display area 106 wherein each pixel is comprised of the area of apparent intersection of a light conducting column 112 and shutter element 114 as viewed from above the display surface 104.

The light source 102 is preferably capable of emitting high intensity, high frequency pulses of light that are conducted to the optical shutter assembly 110 by the light guide assembly 108 so that light is evenly distributed along across the display area 106. The light source 102 may be comprised of an elongated light-generating device mounted to one or more edges of the display surface 104 as shown herein in FIGS. 1 through 5. This arrangement allows the display assembly 100 to have a narrow thickness similar to that of conventional LCDs. However, it is appreciated that other light source configurations are possible. For example, in exemplary embodiments, the light source 102 may be comprised of a central light generating device mounted behind or adjacent to the display surface 104. Similarly, in the embodiment shown in FIGS. 1 through 4, the shutter elements 114 of optical shutter assembly 110 are oriented so as to be generally perpendicular to the light conducting columns 112 of light guide assembly 108. In this manner, a rectilinear matrix or grid of pixels 116 is formed wherein the pixels 116 are arranged in a plurality of parallel rows and columns. However, it should be appreciated that the present invention is not limited to this orientation. For example, shutter elements 114 may be oriented at a non-right angle to light conducting columns 112 so that a non-rectangular matrix is formed wherein each row of pixels 116 is diagonally offset with its adjacent rows. Substitution of such configurations for the configuration illustrated and discussed herein would not depart from the scope and spirit of the present invention.

Figure 2A:
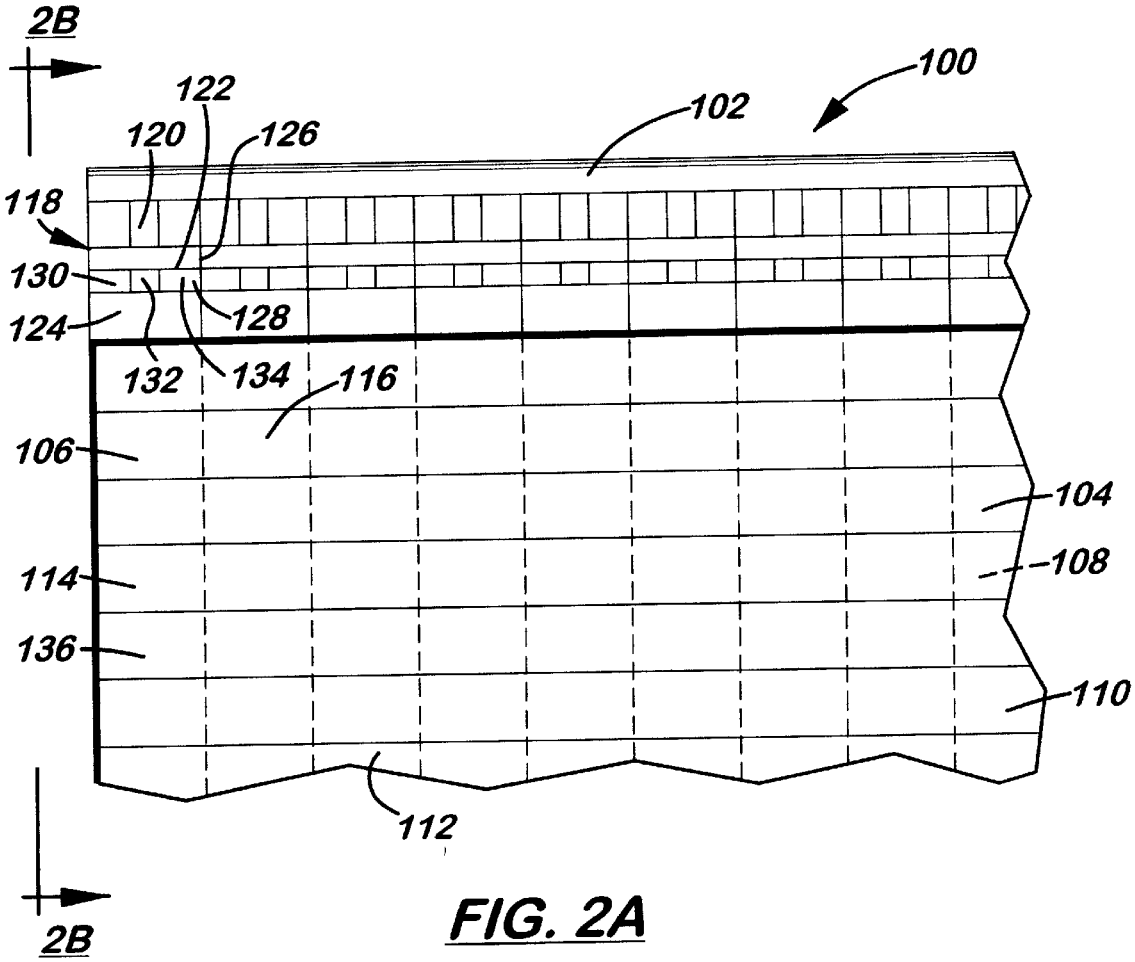
FIGS. 2A and 2B are top plan and side elevational diagrammatic views of the exemplary display assembly shown in FIG. 1.
Figure 2B:
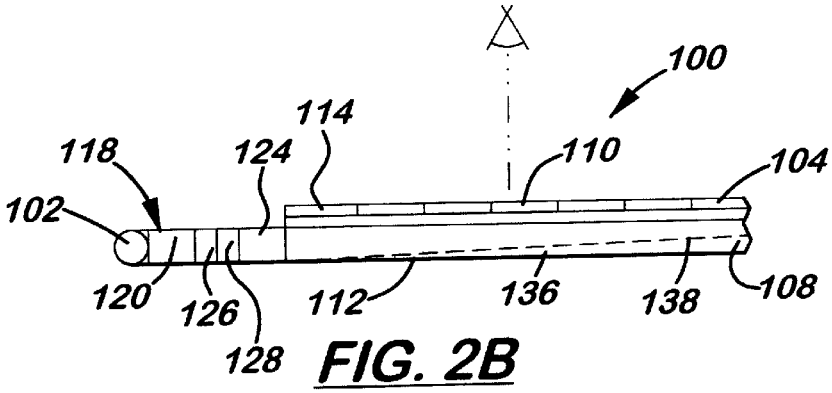

Referring now to FIGS. 1, 2A and 2B, each light conducting column 112 of light guide assembly 108 includes a color adjustment assembly 118 for premixing the primary color components of a color of light to be displayed by each pixel 116 within that light conducting column 112. In an exemplary embodiment, the color adjustment assembly 118 includes a red-green-blue (RGB) filter 120, a shutter element 122, and a diffuser 124. The RGB filter 120 separates light from the light source 102 into its red, green and blue components. The shutter element 122 selects or measures the proper proportions of the red, green and blue light components required to provide the color of light to be displayed by the particular pixel 116 within the light conducting column 112. In exemplary embodiments of the invention, the shutter element 122 is similar in construction to a thin film transistor liquid crystal display (TFT LCD) pixel element utilized in present active matrix LCD displays. In such embodiments, the shutter element 122 is comprised of a polarizing filter or polarizer 126 and a liquid crystal shutter 128 having at least three liquid crystal cells 130, 132 & 134 for adjusting the red, blue and green light components of the color to be displayed. The diffuser 124 diffuses, mixes and randomizes the polarity of the measured red, green and blue light components to produce light having a desired color which is conducted to the pixel 116 by the light conducting column 112. In this manner, the viewer is presented with display elements emitting a true color light instead of separate red, green and blue components provided by sub-pixels. Thus, the viewers eye does not have to interpret separate red, green and blue sub-pixels to perceive the desired color as in existing color displays such as, for example, conventional LCDs, cathode ray tube (CRT) displays, plasma displays, and light emitting polymer (LEP) displays.

As shown, each light conducting column 112 comprises a light guide or light pipe 136 suitable for conducting or transmitting light along the length of the display area 106 with minimal attenuation or loss. The light pipe 136 conducts the light pulses having a premixed color from the color adjustment assembly 118 to the optical shutter assembly 110. In exemplary embodiments of the invention, the light pipes 136 may be fashioned to direct the transmitted pulses of light to the bottom surface of the optical shutter assembly 110 so that the light may be transmitted through the assembly's shutter elements 114 if opened. For example, as shown diagrammatically in FIGS. 1 and 2B, the light pipes 136 may include a reflective surface 138 to reflect the transmitted pulse toward the bottom surface of the optical shutter assembly. This surface 138 may be faceted to maximize the amount of light provided to each shutter element 114. Alternately, the light pipes 136 may include a refraction grating or like optical element for refracting the transmitted pulses of light to the bottom surface of the optical shutter assembly 110.

As described above, the optical shutter assembly 110 may be comprised of a plurality of rows of shutter elements 114 oriented to be generally perpendicular to the light conducting columns 112 of light guide assembly 108. In exemplary embodiments of the invention, shutter elements 114 are comprised of individually controlled elongated liquid crystal (LCD) cells. As shown, each LCD cell may run the entire length of a row of the display area 106 to provide a single isolated shutter. Alternately, a row of the display area 106 may comprise two or more LCD cells. Preferably, the LCD cells may be actuated and de-actuated in response to signals from a display controller (not shown). When actuated, the LCD cell becomes substantially transparent allowing transmission of light. Similarly, when deactuated, the LCD cell becomes opaque substantially blocking transmission of light. In this manner, the LCD cells act as apertures allowing transmission of pulses of light having a premixed color to illuminate one row of pixels 116 within display area 106. In such embodiments, an example of which is shown in FIGS. 1, 2A and 2B, the optical shutter assembly 108 may further include a polarizing filter layer 140 disposed between the rows of shutter elements 114 and the light guide assembly 108. Preferably this polarizing filter layer 140 encompasses at least the entire display area 106 of display surface 104 to polarize the pulses of light transmitted to the shutter elements 114 via the light guide assembly 108. Preferably, the shutter elements 114 also polarize light so that when activated each shutter element may become opaque to block transmission of the light.

As shown in FIGS. 1 through 4B, the present invention typically uses fewer components than a comparable color active matrix LCD. For example, as discussed above, a color active matrix LCD having a 1600×1200 display (1600 columns by 1200 rows of pixels) would have over 5.76 million elements. A display assembly 100 in accordance with the present invention having a 1600×1200 display would utilize only 6000 elements (1600 rows×3 liquid crystal cells 130, 132 & 134 per row×1200 shutter elements 114). Additionally, control circuitry for the present display assembly 100 is placed along the edges of the display surface 104 within the color adjustment assemblies 118 and not within each individual pixel 116 of the display surface 104, thereby reducing the amount of control circuitry required. This reduction in the amount of control circuitry and placement of the control circuitry outside of the display area 106 simplifies manufacture of the display assembly 100, increasing yields and reducing manufacturing costs while allowing additional options in materials from which the display assembly may be manufactured (for example, plastics and the like). Further, by decreasing the amount of control circuitry and by placing the control circuitry along the edges of the display surface 104 where it may be covered and protected, the display assembly 100 is made more durable since the circuitry is less likely to be damaged due to flexure of the display surface 104. Still further, because the amount of control circuitry, which is heat bearing, is greatly reduced, the display assembly 100 may be sealed to provide resistance to environmental contamination thereby providing increased reliability, durability and longevity. Finally, due to the reduction and isolated concentration of the control circuitry, electromagnetic interference (EMI) is also reduced compared to conventional active matrix LCDs.

In the exemplary embodiment shown, display of an image within the display area 106 of display assembly 100 is accomplished by actuating or opening shutter elements 114 in a predetermined sequence so as to sequentially illuminate rows of pixels 116 utilizing pulses of light transmitted to the optical shutter assembly 110 via the light guide assembly 108. The color adjustment assembly 118 adjusts the color of the emitted pulses of light transmitted by each light conducting column 112 each time a new shutter element is actuated so that the color of light to be emitted by each pixel 116 within the row defined by that shutter element 114 is premixed. This sequential actuation or "rastering" of shutter elements 114 is accomplished at a rate sufficient for the viewer's natural persistence of vision to cause the viewer to perceive that all of the pixels 116 within the display area 106 are illuminated at once thereby allowing the viewer to interpret the displayed image. Thus, unlike present LCDs which control output via individual circuits for each pixel, the display assembly 100 of the present invention employs sequencing of light output and shutter similar to a film projector projecting a motion picture.

Preferably, the actuation or opening of each shutter element 114 is synchronized with the emission of a pulse of light by light source 102 to optimize efficiency of the display assembly (brightness and clarity) and to prevent noise (for example, dimly illuminated rows of pixels) due to emission of pulses of light during transition of the shutter elements 114. Further, because only one row of pixels 116 is activated at a time, the light source preferably provides a sufficiently high intensity pulse of light to induce persistence of vision in the viewer allowing the viewer to, in effect, continue to see the pixels of each row while other rows of pixels are sequentially illuminated.

Figure 3A:
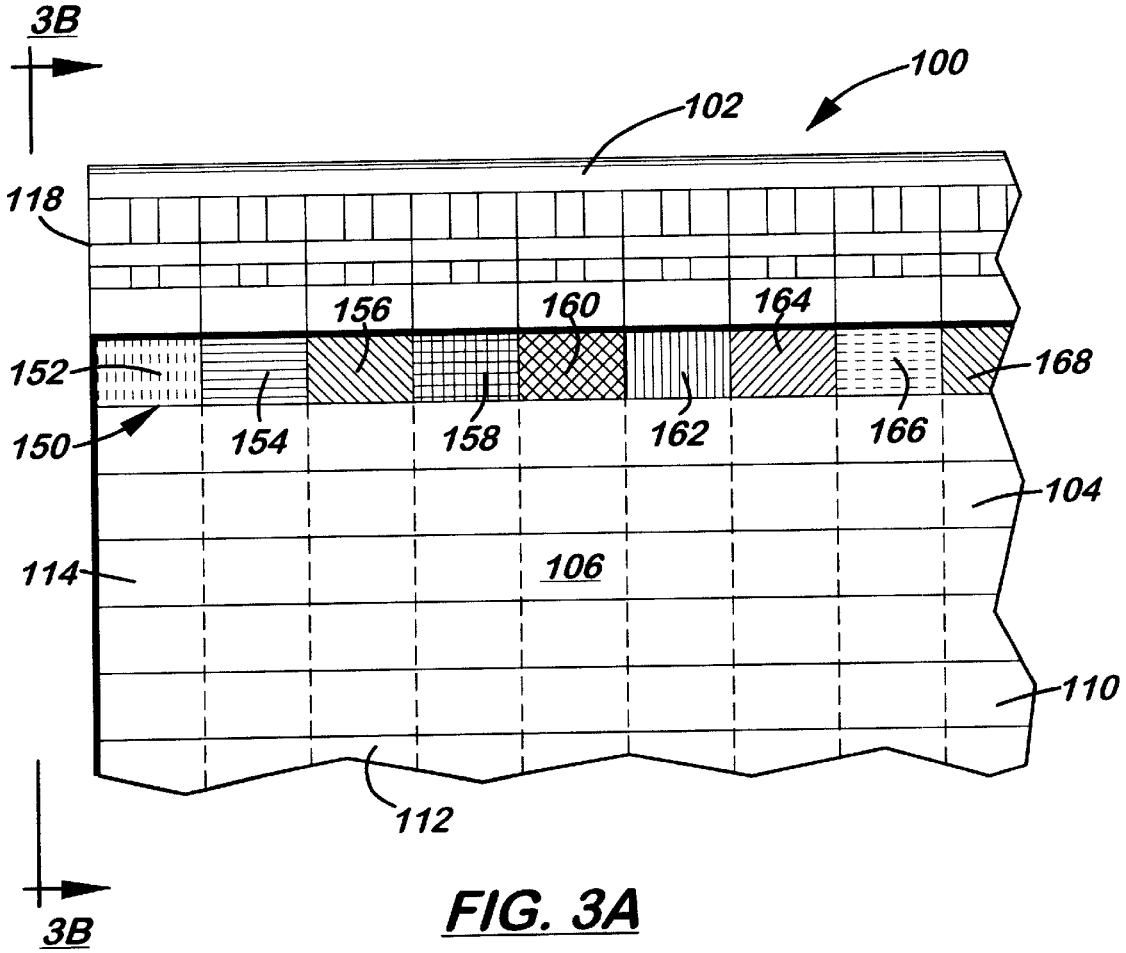
FIGS. 3A and 3B are top plan and side elevational diagrammatic views of the exemplary display assembly shown in FIG. 1, illustrating illumination of a first row of display elements.
Figure 3B:
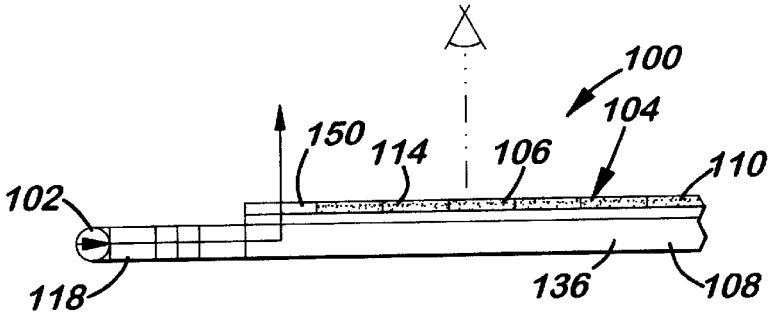
Figure 4A:
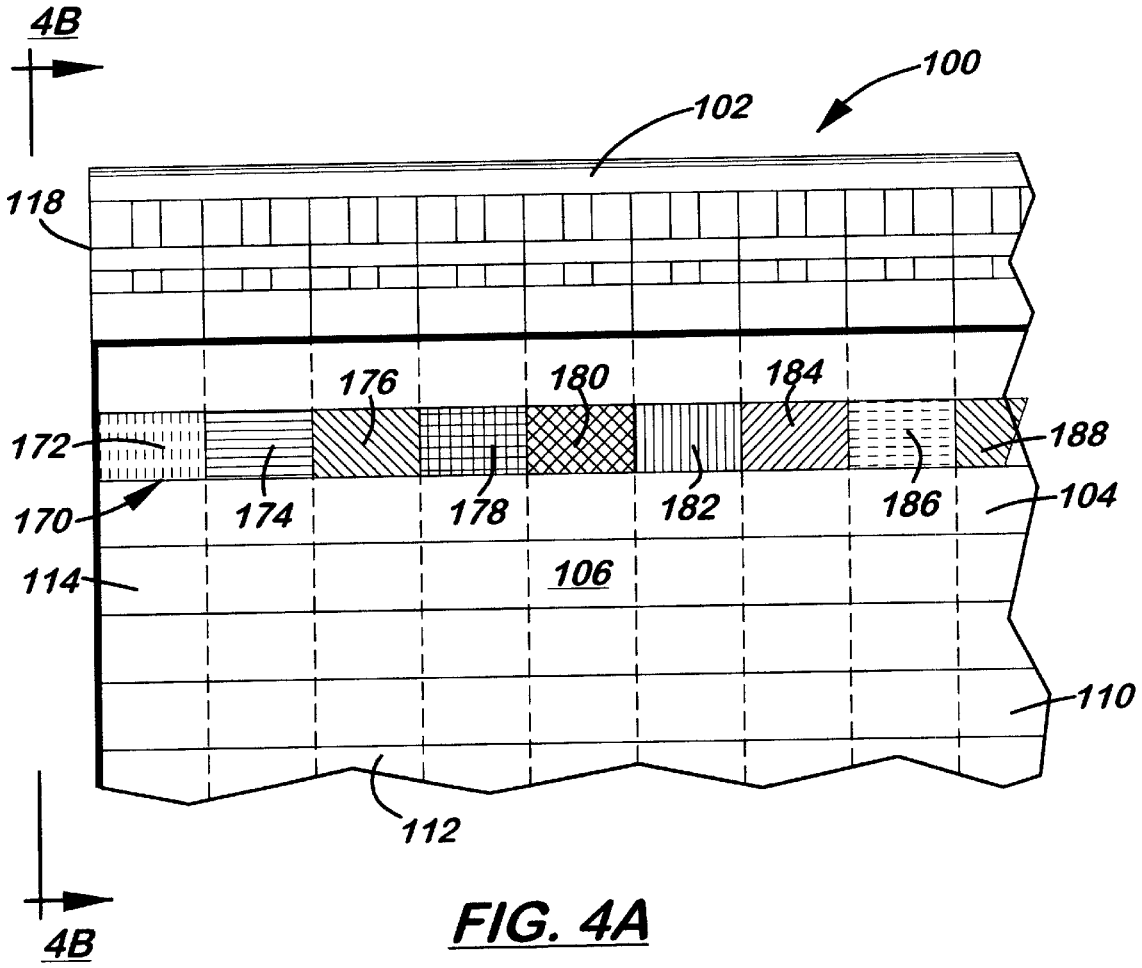
FIGS. 4A and 4B are top plan view and side elevational diagrammatic views of the exemplary display assembly shown in FIG. 1, illustrating illumination of a second row of display elements.
Figure 4B:
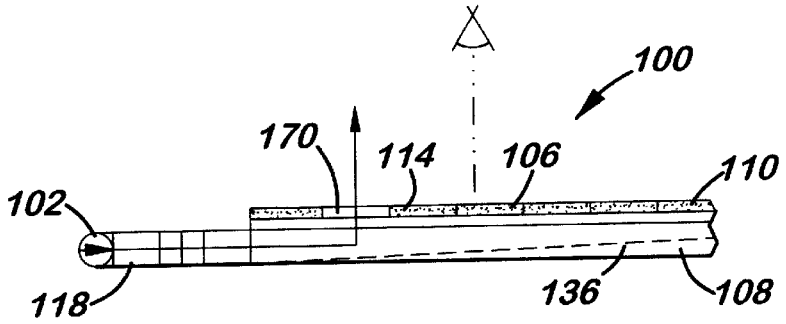

Referring now to FIGS. 3A, 3B, 4A and 4B, illumination of adjacent rows of pixels in sequence is described in detail. In FIGS. 3A and 3B, a first row 150 of display elements or pixels 152–168 is shown illuminated. A pulse of light is provided to each light conducting column 112 of light guide assembly 108 by light source 102. The light pulse is separated into its red, green and blue component parts by RGB filter 120 and polarized by polarizing filter 126. The shutter 128 selects or measures the proper proportions of the red, green and blue light components required to provide the color of light to be displayed by the particular pixels 152–168 in the row being illuminated. The color components are then mixed and randomized by diffuser 124 and the colored light pulse transmitted to the optical shutter assembly 110 by light pipe 136. Next, the shutter element 114 corresponding to the row of pixels 150 being illuminated is opened allowing the pulse of light having a premixed color for each pixel 152–168 to be transmitted though the optical shutter assembly 110. As shown in FIGS. 4A and 4B, once the first pulse of light has been transmitted, the shutter element 114 corresponding to the first row of pixels 150 is de-actuated or closed. A second pulse of light is then provided to each light conducting column 112 of light guide assembly 108 by light source 102. This light pulse's color is similarly adjusted or premixed to provide the color of light to be displayed by the particular pixels 172–188 in the next row 170 being illuminated, and transmitted the optical shutter assembly 110 by light pipe 136. The next shutter element 114 corresponding to the row of pixels 170 being illuminated is opened allowing the pulse of light having a premixed color for each pixel 172–188 to be transmitted though the optical shutter assembly 110. This process is continuously repeated for each row of pixels within the display area 106 at a rate sufficient for the viewer's natural persistence of vision to cause the viewer to perceive that all of the pixels 116 within the display area 106 are illuminated at once thereby allowing the viewer to interpret the displayed image.

Signaling within the present display assembly 100 is preferably similar to that employed by other flat panel displays. However, instead of using a two-axis method of scanning, the present invention would refresh an entire row or axis and repeat. Thus, unlike present signal decoding for active matrix LCDs which require mapping of the entire display area, the present invention only requires a map of a single row at one time, and a simple sequencing of shutter elements 114.

Figure 5:
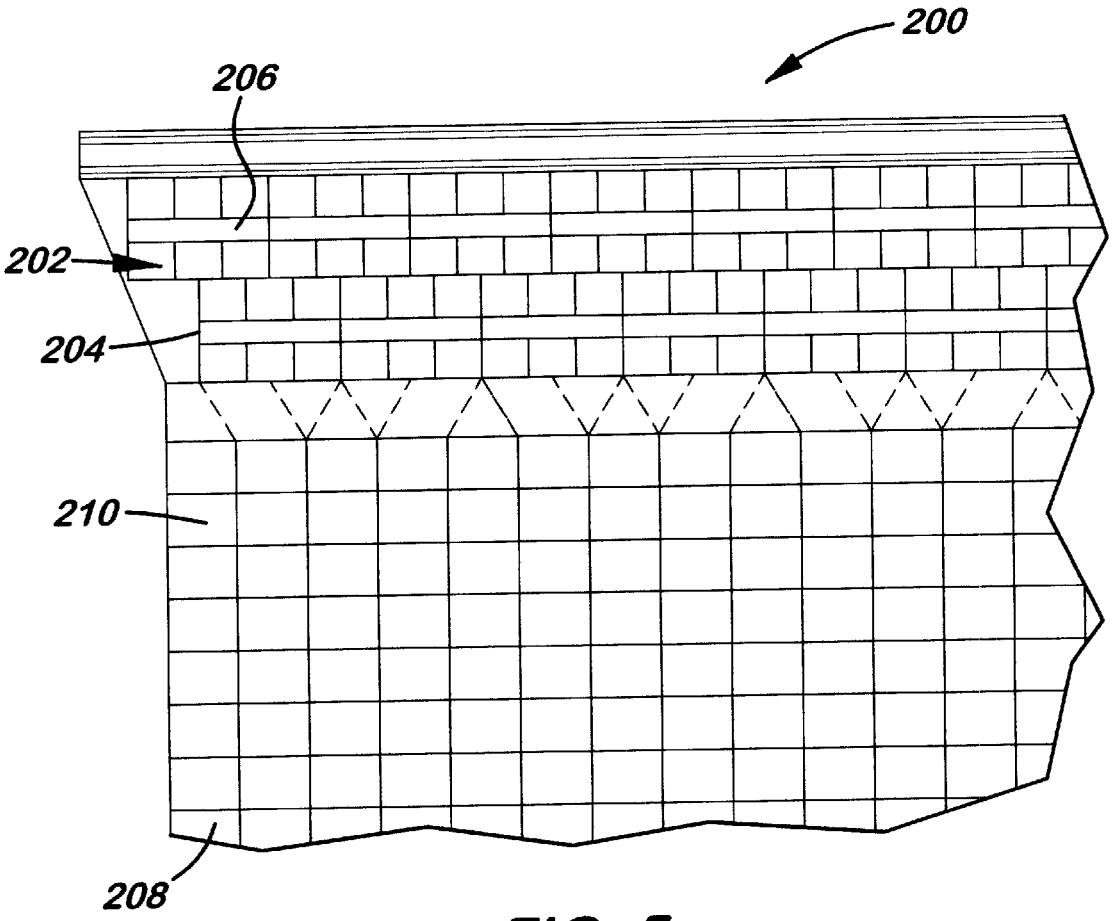
FIG. 5 is an isometric diagrammatic view of an exemplary display assembly wherein the display assembly's color adjustment elements are staggered to increase the density of light conducting columns in the display.

Active matrix LCDs are limited in that the size of their pixels cannot be reduced beyond the area occupied by the pixel's control circuitry (TFT). The present invention allows for the provision of smaller pixels than active matrix LCDs since the control circuitry is placed along the edges of the display and not within each individual pixel of the display area 106. Further, in the present invention, staggering or other mechanical arrangements may likewise be utilized to increase the density of columns within the display assembly thereby increasing the density of pixels within the display and providing a higher fidelity image. For example, in FIG. 5, an exemplary display assembly 200 is shown having staggered groups 202 & 204 of color adjustment assemblies 206. These color adjustment assemblies 206 each adjust or premix the color of light transmitted by a light conducting column 208 within display surface 210 as discussed above in the description of FIGS. 1 through 4A. However, as shown in FIG. 5, each group of color adjustment assemblies 206 may be staggered transversely, longitudinally, and/or vertically within the display assembly 200 allowing the width of light pipes 212 to be reduced. In this manner, the density of light conducting columns 208 in the display assembly 200 may be increased.

Figure 6:
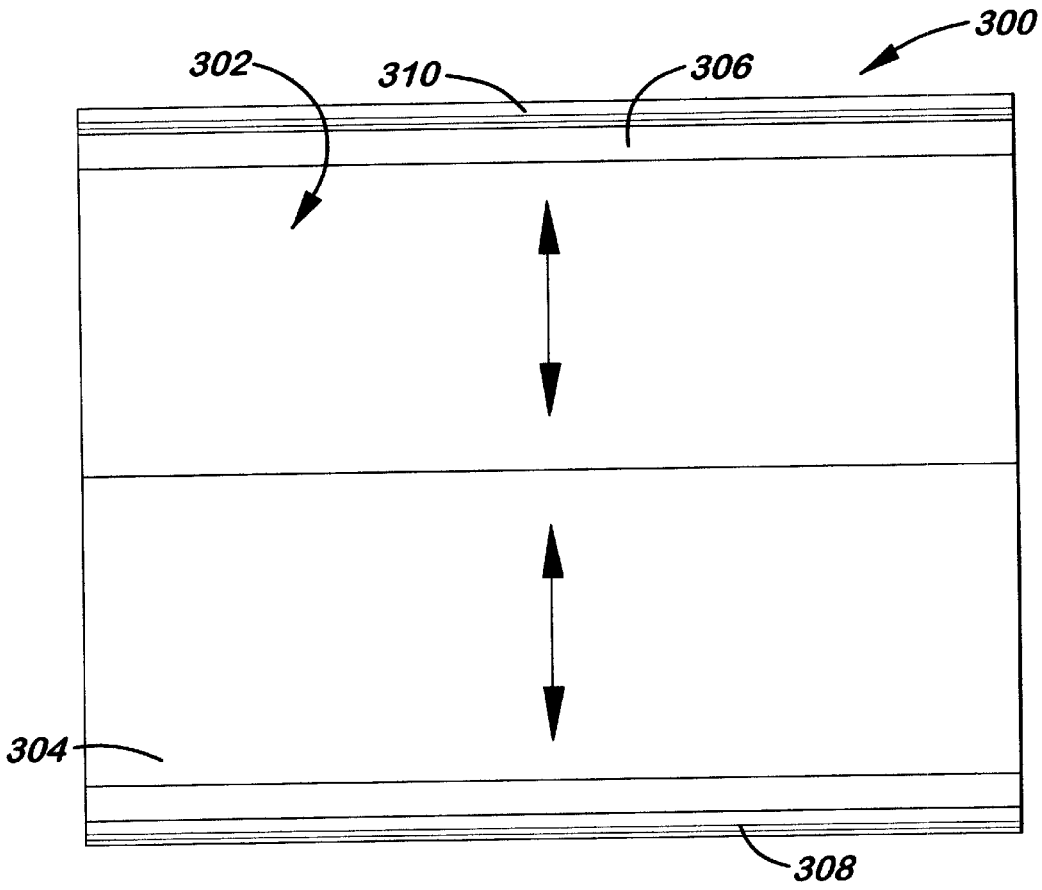
FIG. 6 is a top plan diagrammatic view of a display assembly in accordance with an exemplary embodiment of the present invention wherein the display assembly is divided into two sections which are operated in parallel with each other to increase light output and/or refresh rate of the display.
Figure 7:
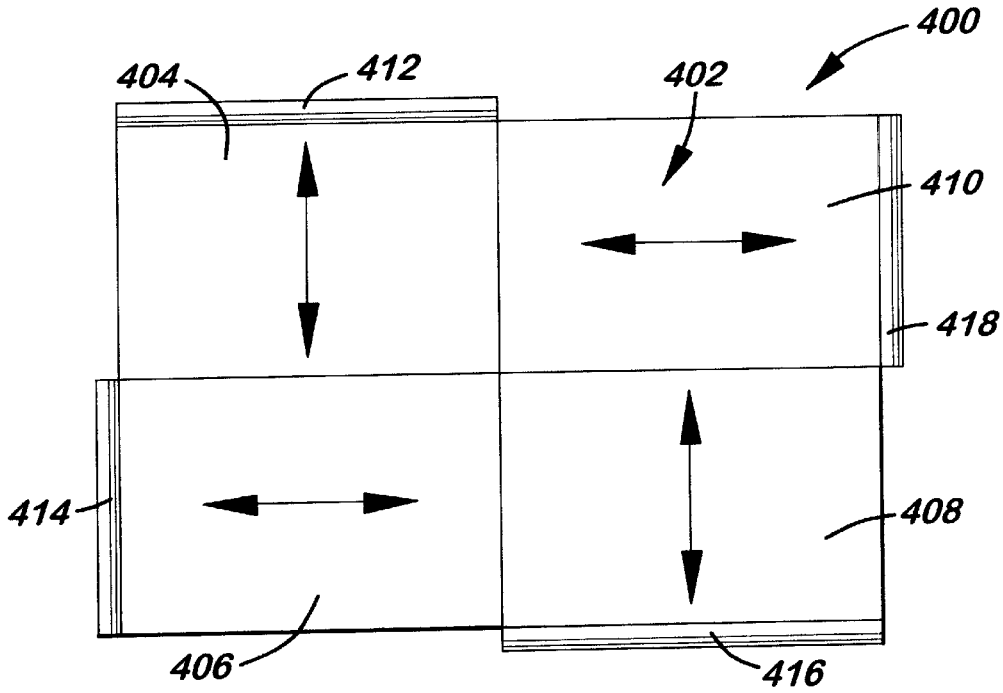
FIG. 7 is a top plan diagrammatic view of a display assembly in accordance with an exemplary embodiment of the present invention wherein the display assembly is divided into four sections which are operated in parallel with each other to increase light output and/or refresh rate of the display.

Referring now to FIGS. 6 and 7, exemplary display assemblies in accordance with the present invention are shown wherein the display is divided into multiple sections. These sections may then operate in parallel with each other thereby increasing light output and/or refresh rate. For instance, FIG. 6 illustrates an exemplary display assembly 300 comprised of a display surface 302 having two sections 304 & 306 employing separate light sources 308 & 310 thereby doubling the screen's light output and effective refresh rate. Similarly, FIG. 7, illustrates an exemplary display assembly 400 comprised of a display surface 402 having four sections 404, 406, 408 & 410 employing separate light sources 412, 414, 416 & 418 thereby quadrupling the screen's light output and effective refresh rate. It will be appreciated that exemplary display assemblies in accordance with the present invention may have any number of sections as contemplated by one of ordinary skill in the art.

Figure 8:
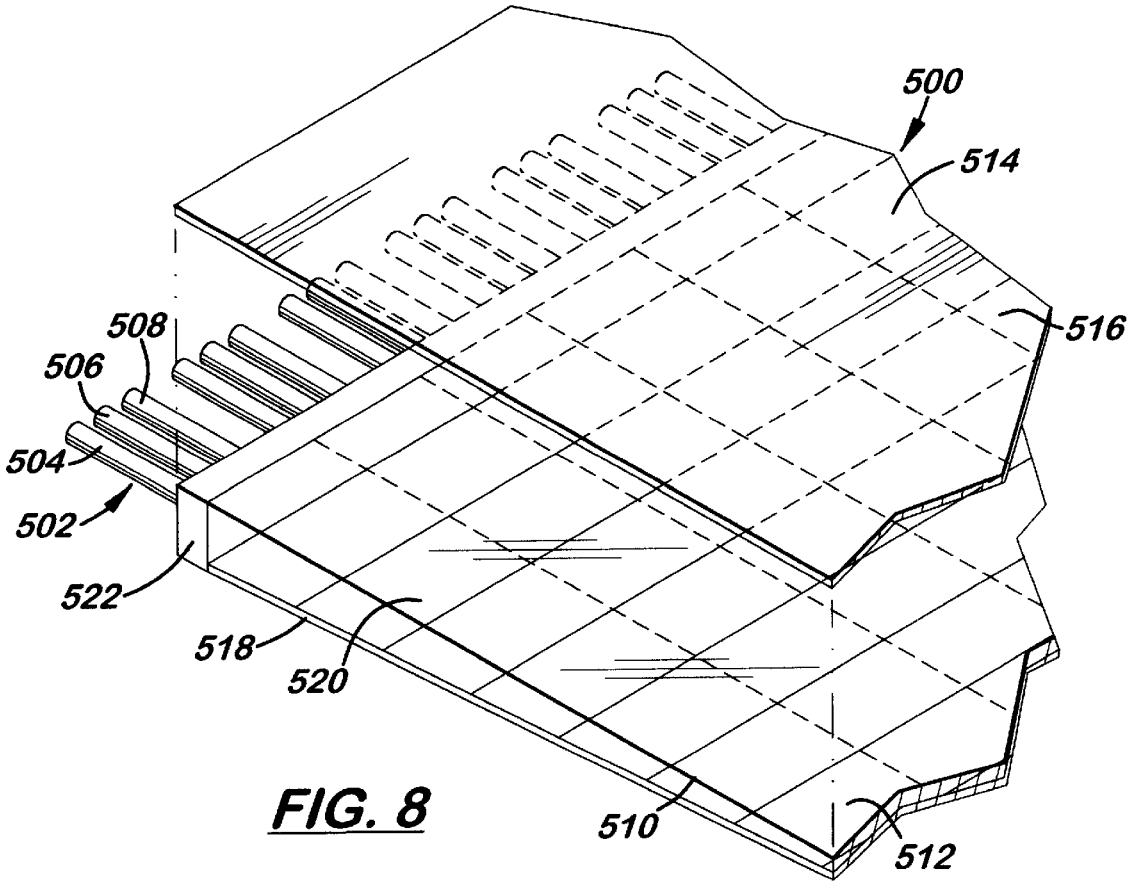
FIG. 8 is an isometric diagrammatic view of a display assembly in accordance with a second exemplary embodiment of the present invention.
Figure 9:
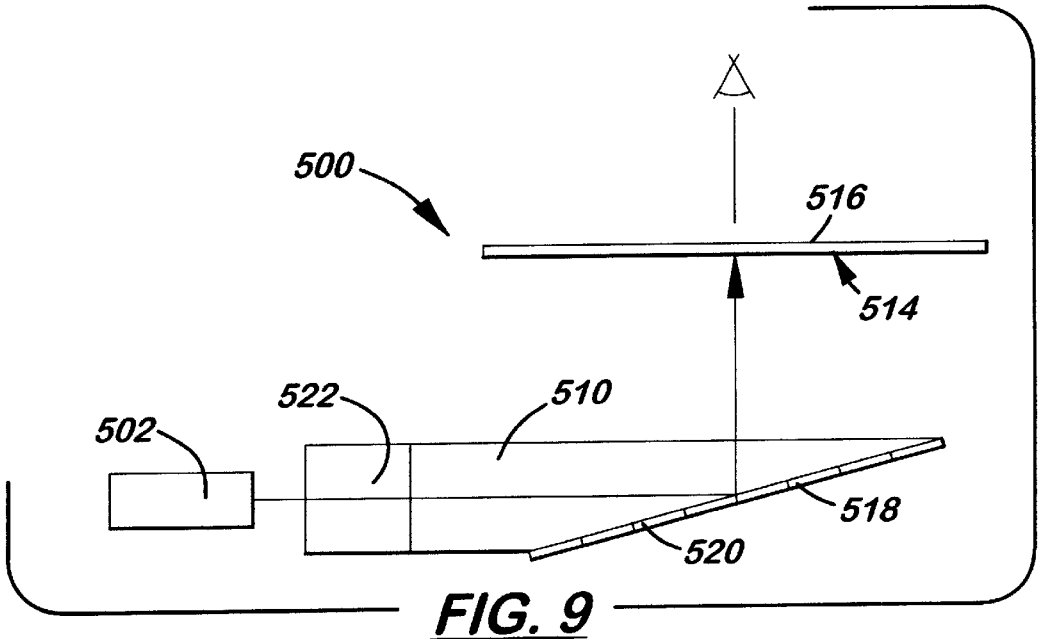
FIG. 9 is a side elevational diagrammatic view of the exemplary display assembly shown in FIG. 8.

Referring now to FIGS. 8 and 9, a display assembly in accordance with an exemplary embodiment of the present invention is described wherein the shutter elements of the display assembly are utilized to selectively reflect light to a display surface such as a diffuser or the like. The display assembly 500 includes a light source 502 comprised of one or more light emitting devices 504, 506 & 508 devices capable of emitting pulses of substantially coherent light. In exemplary embodiments, light emitting devices 504, 506 & 508 may be comprised of LASER (Light Amplification by Stimulated Emission of Radiation) devices or the like capable of emitting coherent light having the colors of red, blue and green. The light source 502 is coupled to a light guide assembly 510 and an optical shutter assembly 510 suitable for directing the pulses of coherent light to a display surface 514 having a display area 516 suitable for displaying an image or images to a viewer. The light guide assembly 510 is comprised of a plurality of substantially parallel light conducting columns 518 extending along one axis of the display assembly 500. The optical shutter assembly 512 is comprised of a plurality of substantially parallel rows of elongated shutter elements 520 arranged along a second axis of the display assembly 500 so as to cross the light conducting columns 518 to form a plurality of display elements 516 wherein each display element 516 is comprised of the area of apparent intersection of a light conducting column 518 and a shutter element 520.

Referring now to FIG. 8, each light conducting column 518 of light guide assembly 510 includes a color adjustment assembly 524 for premixing the primary color components of a color of light to be transmitted to each display element 516 within that light conducting column 518. Each light conducting column 518 further comprises a light guide or light pipe 526 suitable for conducting or transmitting light along the length of the optical shutter assembly 512 with minimal attenuation or loss. The light pipe 526 conducts the light pulses having a premixed color from the color adjustment assembly 524 to the optical shutter assembly 512. As shown, the light pipes 136 may be fashioned to direct the transmitted pulses of light to the top surface of the optical shutter assembly 512 so that the light may be reflected to the display surface 514 by the assembly's shutter elements 522 if actuated.

In the exemplary embodiment shown in FIGS. 8 and 9, the shutter elements 520 of optical shutter assembly 512 are oriented so as to be generally perpendicular to the light conducting columns 518 of light guide assembly 510. In this manner, a rectilinear matrix or grid of display elements 516 is formed wherein the display elements or pixels 516 are arranged in a plurality of parallel rows and columns. However, it should be appreciated that the present invention is not limited to this orientation. For example, shutter elements 520 may be oriented at a non-right angle to light conducting columns 518 so that a non-rectangular matrix is formed wherein each row of display elements 516 is diagonally offset with its adjacent rows.

In an exemplary embodiment shown in FIGS. 8 and 9, display surface 514 may be comprised of a diffuser for diffusing the pulses of light reflected to the display surface to provide a uniform image within the display area. In such an embodiment, the display screen 514 is viewed from the side opposite the light guide and optical shutter assemblies 510 & 512. Alternately, display surface 514 may comprise a flat uniform surface such as a projection screen, wall, or the like wherein light reflected from the optical shutter assembly 512 is projected past the viewer so that the display surface 514 is viewed from the same side as the light guide and optical shutter assemblies 510 & 512.

In exemplary embodiments of the invention, shutter elements 114 are comprised of individually controlled elongated liquid crystal (LCD) shutter elements. Preferably, these LCD shutter elements may be actuated and de-actuated in response to signals from a display controller (not shown). When actuated, the LCD shutter element is closed and becomes substantially opaque having a reflective surface capable of reflecting of light. Similarly, when de-actuated, the LCD shutter element is opened becoming transparent so that it will not reflect light. In this manner, the LCD shutter elements act as mirrors or reflectors allowing transmission of a pulses of light having a premixed color to illuminate points on the display surface 514 within display area 516.

Display of an image within the display area 516 of display surface 514 is accomplished by actuating or closing shutter elements 522 in a predetermined sequence so as to sequentially illuminate points of the display surface 514 utilizing pulses of coherent light having a premixed color. In exemplary embodiments, these pulses of light are generated by the light source 502 and transmitted to the optical shutter assembly 512 via the light guide assembly 510. The color adjustment assembly 524 adjusts the color of the emitted pulses of light transmitted by each light conducting column 518 each time a new shutter element 522 is actuated so that the color of light to be reflected to the display surface 514 by each display element 516 within the row defined by that shutter element 522 is premixed. This sequential actuation or "rastering" of shutter elements 522 is accomplished at a rate sufficient for the viewer's natural persistence of vision to cause the viewer to perceive the displayed image within display area 516. Preferably, the actuation of each shutter element 522 is synchronized with the emission of a pulse of light by light source 502 to optimize efficiency of the display assembly (brightness and clarity) and to prevent noise (for example, dimly illuminated spots on the display surface) due to emission of pulses of light during transition of the shutter elements 522.

It should be appreciated that the terms "row" and "column" are used herein to describe the nature of the intersection of the elements of the light guide assemblies and optical shutter assemblies of the present invention and are not meant to indicate an orientation (e.g., horizontal or vertical) of the exemplary display assemblies described herein nor should such orientation be implied.

Exemplary embodiments of the display assembly of the present invention are described herein which are suitable for use in flat panel displays employed by such devices a computer system monitors, televisions, terminals and the like. However, it is contemplated that display assemblies in accordance with the present invention may be adapted by those of ordinary skill in the art for use in applications where large displays are required. Such application may include, for example, signs, billboards, and displays suitable for use in arenas and like public areas. Use of the present display assembly in such applications would not depart from the scope and spirit of the invention.

It is believed that the display assembly of the present invention and many of its attendant advantages will be understood by the forgoing description, and it will be apparent that various changes may be made in the form, construction and arrangement of the components thereof without departing from the scope and spirit of the invention or without sacrificing all of its material advantages, the form herein before described being merely an explanatory embodiment thereof. It is the intention of the following claims to encompass and include such changes.

What is claimed is:

1. A display assembly, comprising:

a light source suitable for emitting pulses of light;

an optical shutter assembly including a plurality of individually actuateable shutter row elements capable of substantially allowing or blocking transmission of pulses of light emitted by said light source;

a light guide assembly suitable for conducting light to said optical shutter assembly; and a plurality of light conducting columns suitable for conducting light along an axis of the display assembly, each of said plurality of light conducting columns including a color adjustment assembly for adjusting the color of said light conducted by said light conducting column;

wherein selected ones of said plurality of shutter row elements are actuated in a predetermined sequence for allowing transmission of said pulses of light conducted from said light source via said light guide assembly.

2. The display assembly as claimed in claim 1, wherein said light source comprises a strobe light source capable of generating high intensity pulses of light.

3. The display assembly as claimed in claim 1, wherein said predetermined sequence is configured to allow a user's persistence of vision to form an image displayed by said display assembly.

4. The display assembly as claimed in claim 1, wherein each of said plurality of light conducting columns includes a color filter for filtering pulses of light emitted by said light source into at least one color and a shutter element for selecting the color of said pulses of light conducted by said conducting columns.

5. The display assembly as claimed in claim 4, wherein said color filter element comprises red, blue, and green filters.

6. The display assembly as claimed in claim 5, wherein said shutter element comprises a liquid crystal shutter element suitable for adjusting the proportion of light passing through said red, green and blue filters.

7. The display assembly as claimed in claim 6, wherein said color filter further comprises a diffuser for diffusing, randomizing and mixing the red, green and blue light components passing through said liquid crystal shutter elements.

8. The display assembly as claimed in claim 4, wherein said color filter further comprises a polarizer.

9. The display assembly as claimed in claim 4, further comprising a polarizing layer for polarizing said pulses of light conducted to said plurality of shutter rows.

10. The display assembly as claimed in claim 1, wherein each of said plurality of shutter elements of said shutter assembly comprises an elongated liquid crystal shutter row.

11. A display assembly, comprising:

a light source suitable for emitting pulses of light;

a display surface having a plurality of display elements, said display surface including:

a first layer comprising of a plurality of light conducting columns suitable for conducting said pulses of light received from said light source along an axis of the display surface, each of said plurality of light conducting columns including a color adjustment assembly for adjusting the color of said pulses of light conducted by said conducting column; and a second layer disposed on said first layer, said second layer comprising a plurality of shutter rows oriented generally perpendicular to said light conducting columns, each shutter row being capable of substantially allowing or blocking transmission of said pulses of light conducted from said light source via said plurality of light conducting columns;

wherein selected ones of said plurality of shutter rows are actuated in synchronization with said pulses of light emitted from said light source for at least partially allowing transmission of said pulses of light through said second layer thereby illuminating rows of said plurality of display elements.

12. The display assembly as claimed in claim 11, wherein each of said plurality of shutter rows is actuated in sequence at a rate sufficient for allowing a user's persistence of vision to form an image displayed by said plurality of display elements.

13. The display assembly as claimed in claim 11, wherein said color adjustment assembly comprises:

a color filter assembly; and a second shutter assembly for selectively mixing light passing through said color filter assembly.

14. The display assembly as claimed in claim 13, wherein said color filter assembly comprises red, blue, and green filters for providing the primary red, blue and green color components of the true color.

15. The display assembly as claimed in claim 14, wherein said second shutter assembly comprises at least one liquid crystal shutter element suitable for adjusting the proportion of light passing through said red, green and blue filters.

16. The display assembly as claimed in claim 15, further comprising a diffuser for diffusing, randomizing and mixing the red, green and blue light components passing through said liquid crystal shutter elements.

17. The display assembly as claimed in claim 13, wherein said color adjustment assembly further comprises a polarizer.

18. The display assembly as claimed in claim 11, wherein said display surface further comprises a polarizing layer for polarizing said pulses of light conducted to said plurality of shutter rows.

19. The display assembly as claimed in claim 11, wherein said light source comprises a high intensity strobed light source.

20. The display assembly as claimed in claim 11, wherein each of said plurality of shutter rows comprises an elongated liquid crystal shutter.

21. A display assembly, comprising:

a light source suitable for emitting pulses of light;

a plurality of light conducting columns suitable for conducting said pulses of light received from said light source along an axis of the display assembly, each of said plurality of light conducting columns including a color filter for filtering pulses of light emitted by said light source into at least one color and a shutter element for selectively mixing light passing through said color filter element for adjusting the color of said pulses of light conducted by said conducting columns; and a plurality of shutter rows oriented generally perpendicular to said light conducting columns so as to form a plurality of display elements, said shutter rows being capable of substantially allowing or blocking transmission of said pulses of light conducted from said light source via said plurality of light conducting columns;

wherein selected ones of said plurality of shutter rows are actuated in synchronization with said pulses of light emitted from said light source allowing transmission of said pulses of light for illuminating rows of said plurality of display elements.

22. The display assembly as claimed in claim 21, wherein each of said plurality of shutter rows is actuated in sequence at a rate sufficient for allowing a user's persistence of vision to form an image displayed by said plurality of display elements.

23. The display assembly as claimed in claim 21, wherein each of said color filter elements comprises red, blue, and green filters for providing the primary red, blue and green color components of the true color to be displayed by the display element.

24. The display assembly as claimed in claim 22, wherein said shutter element comprises a liquid crystal shutter element suitable for adjusting the proportion of light passing through said red, green and blue filters.

25. The display assembly as claimed in claim 24, wherein each of said light conducting columns further comprises a diffuser for diffusing, randomizing and mixing the red, green and blue light components passing through said liquid crystal shutter elements.

26. The display assembly as claimed in claim 24, wherein each of said light conducting columns further comprises a polarizer.

27. The display assembly as claimed in claim 21, further comprising a polarizing layer disposed between said plurality of light conducting columns and said plurality of shutter rows.

28. The display assembly as claimed in claim 21, wherein said light source comprises a high intensity strobed light source.

29. The display assembly as claimed in claim 21, wherein each of said plurality of shutter rows comprises an elongated liquid crystal shutter.

30. A display assembly, comprising:

a light source capable of emitting a pulse of generally coherent light;

a display surface;

a plurality of light conducting columns suitable for conducting said pulses of generally coherent light received from said light source along an axis of the display assembly, each of said plurality of light conducting columns including a color adjustment assembly for adjusting the color of said pulses of generally coherent light conducted by said conducting column; and a plurality of shutter rows capable actuation for selectively reflecting said pulses of generally coherent light conducted from said light source via said plurality of light conducting columns;

wherein selected ones of said plurality of shutter rows are actuated in synchronization with said pulses of generally coherent light emitted from said light source allowing reflection of said generally coherent pulses of light for illuminating said display surface.

31. The display assembly as claimed in claim 30, wherein each of said plurality of shutter rows is actuated in sequence at a rate sufficient for allowing a user's persistence of vision to form an image displayed on display surface.

32. The display assembly as claimed in claim 31, wherein said display surface comprises a diffuser.

33. The display assembly as claimed in claim 31, wherein each of said plurality of shutter rows comprises an elongated liquid crystal shutter.

* * * * *